US006397031B1

(12) United States Patent
Itoh

(10) Patent No.: US 6,397,031 B1
(45) Date of Patent: May 28, 2002

(54) DEVELOPMENT APPARATUS WITH FIRST AND SECOND DEVELOPER CARRYING MEMBER AND A PLURALITY OF MAGNETIC FIELD GENERATING MEANS FOR REGULATING DEVELOPER LAYER THICKNESS

(75) Inventor: Isami Itoh, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/648,736

(22) Filed: Aug. 28, 2000

(30) Foreign Application Priority Data

Aug. 30, 1999 (JP) ..... 11-243478

(51) Int. Cl.[7] ..... G03G 15/09
(52) U.S. Cl. ..... 399/269; 399/274
(58) Field of Search ..... 399/267, 269, 399/272, 274

(56) References Cited

U.S. PATENT DOCUMENTS 2,297,691 A 10/1942 Carlson ..... 95/5
2,874,063 A 2/1959 Greig ..... 117/17.5
3,909,258 A 9/1975 Kotz ..... 96/1 R
4,356,245 A 10/1982 Hosono et al. ..... 430/122
5,545,840 A * 8/1996 Doi et al. ..... 399/274

FOREIGN PATENT DOCUMENTS

| | | |
|---|---|---|
| JP | 42-23910 | 11/1942 |
| JP | 43-24748 | 10/1943 |
| JP | 52-94140 | 8/1977 |
| JP | 54-43036 | 4/1979 |

* cited by examiner

*Primary Examiner*—William J. Royer
(74) *Attorney, Agent, or Firm*—Fitzpatrick, Cella, Harper & Scinto

(57) ABSTRACT

A development apparatus includes a first developer carrying member for carrying developer and is adapted to develop a latent image formed on an image bearing member with the developer at a first developing area. A second developer carrying member carries the developer and is adapted to develop the latent image formed on the image bearing member with the developer at a second developing area. A regulating member is borne on the second developer carrying member and is adapted to regulate a thickness of a layer of the developer. The second developer carrying member regulates a thickness of a layer of the developer carried on the first developer carrying member.

10 Claims, 7 Drawing Sheets

DEVELOPMENT APPARATUS WITH FIRST AND SECOND DEVELOPER CARRYING MEMBER AND A PLURALITY OF MAGNETIC FIELD GENERATING MEANS FOR REGULATING DEVELOPER LAYER THICKNESS

BACKGROUND OF THE INVENTION

1. Field of the Invention

The present invention relates to a development apparatus used in an image forming apparatus such as an electrographic apparatus or an electrostatic recording apparatus.

2. Related Background Art

In the past, as disclosed in U.S. Pat. No. 2,297,691, Japanese Patent Post-Examination Publication No. 42-23910 and Japanese Patent Post-Examination Publication No. 43-24748, various methods are well-known, such as electrophotography. In general, an electrostatic latent image is formed on a photosensitive member formed from photoconductive material by various means, and then the latent image is developed by using toner as a toner image, which is in turn transferred onto a transfer material, such as paper. The toner image transferred to the transfer material is fixed to the transfer material by heating or solvent vapor, thereby obtaining a copy (reproduction).

As a developing method, various methods in which an electrical latent image is visualized by using two-component developer mainly including toner and carrier are already known. For example, there are various developing methods such as a magnetic brush developing method as disclosed in U.S. Pat. No. 2,874,063, a powder cloud method, a fur brush developing method, a liquid developing method and the like.

The magnetic brush method and liquid developing method using the two-component developer have widely been put to practical use since a good image can be obtained relatively stably. However, since both methods utilize the developer obtained by mixing the toner and the carrier, they have disadvantages such as deterioration of the carrier, variation in mixing ratio between the toner and the carrier, complication of the apparatus, scattering of the toner and/or uneven streak due to the presence of the carrier.

In order to eliminate such disadvantages, various developing methods using one-component developer (one-component toner) consisting of toner alone have been proposed. For example, U.S. Pat. No. 3,909,258 discloses a developing method using magnetic toner having electrical conductivity. In this method, conductive magnetic toner is carried on a cylindrical developing sleeve having a magnet therein, and, development is effected by contacting the developing sleeve with the latent image. During the development, in a developing portion where the developing sleeve is opposed to a photosensitive member, a conductive path is formed between the surface of the photosensitive member and the surface of the developing sleeve by toner particles so that charges are directed from the developing sleeve to the toner particles through the conductive path, with the result that the toner particles are adhered to an imaged portion by a Coulomb force between the imaged portion of the latent image and the toner particles, thereby developing the latent image.

Although the developing method using the conductive magnetic toner can eliminate the problems regarding the conventional two-component developing methods, since the toner is conductive, it has a disadvantage that it is difficult to electrostatically transfer the developed image from the photosensitive member to an ultimate support member such as a plain paper.

In order to eliminate this disadvantage, a developing method using high-resistance magnetic toner capable of being transferred electrostatically is disclosed in Japanese Patent Application Laid-open No. 52-94140 as a developing method utilizing dielectric polarization of toner particles. However, this method has a disadvantage that adequate density of the developed image cannot be obtained because the developing speed is essentially low, and, thus, it is difficult to put this method to practical use.

As another method using high-resistance magnetic toner, a developing method in which toner particles are frictionally charged by friction between the toner particles and friction between the toner particle and the developing sleeve and the development is effected by contacting the charged toner particles with the photosensitive member is known. However, it has been pointed out that this method has a disadvantage that poor frictional charging may occur because of small number of contacts between the toner particles and a friction member or the toner particles are apt to be aggregated on the developing sleeve if the Coulomb force between the charged toner particles and the developing sleeve, and it is practically difficult to realize this method.

On the other hand, in Japanese Patent Application Laid-open No. 54-43036, a new developing method eliminating the above-mentioned disadvantages has been proposed. In this method, magnetic toner is coated on a developing sleeve as a very thin layer and is frictionally charged and then a latent image is developed under a magnetic field by approaching the toner layer to the latent image without contacting with the latter.

According to this method, by coating the magnetic toner as the very thin layer, the chance for contact between the magnetic toner and the developing sleeve is increased thereby to permit the frictional charges required for development to be applied to the toner.

FIG. 5 shows an example of a magnetic one-component developing apparatus. As shown in FIG. 5, the developing apparatus comprises a developing container 10 containing magnetic one-component toner as developer, which container including a developing. sleeve 1, a permanent magnet 1*a*, two large and small toner conveying members 4 and a magnetic blade 11. The developing sleeve 1 is formed from a non-magnetic member and is disposed within an opening portion opposed to a photosensitive drum 100 as an image bearing member for rotation in a direction shown by the arrow B2, and the permanent magnet 1*a* has a roller shape and is disposed within the developing sleeve in a non-rotation manner.

The magnetic toner in the developing container 10 is conveyed to the developing sleeve 1 by the conveying members 4 and is borne on the surface of the developing sleeve 1 by a magnetic force of the magnet 1*a* and then is conveyed to a developing portion opposed to the photosensitive drum 100 as the developing sleeve 1 is rotated. On the way of the conveyance, the toner is regulated by the magnetic blade 11 spaced apart from the developing sleeve 1 by a distance W, with the result that a thin toner layer is coated on the developing sleeve 1. The distance W is generally selected to be 100 $\mu$m to 1 mm.

A thickness of the toner layer coated on the developing sleeve 1 is determined by a position of a cut line L shown in FIG. 7. According to the inventors' investigation, it was found that performance of the magnet toner will be as follows when the magnetic toner passes between the developing sleeve 1 and the magnetic blade 11.

As shown in FIG. 6, when planes perpendicular to a straight line connecting between the developing sleeve 1 and the magnetic blade 11 are considered and it is assumed that a plane near the magnetic blade is S1 and a plane near the developing sleeve 1 is S2, since a width of the magnetic blade 11 is generally selected to be smaller than a width of the magnet 1*a*, when magnetic flux densities on the planes S1, S2 are considered, the magnetic flux density on the plane S1 becomes greater than that on the plane S2. Accordingly, the magnetic toner on the developing sleeve 1 is subjected to a magnetic force directed toward a direction shown by the arrows, i.e., toward the magnetic blade 11 between the developing sleeve 1 and the magnetic blade 11, with the result that, as shown in FIG. 7, the magnetic toner particles t are interconnected between the developing sleeve 1 and the magnetic blade 11 thereby to form chains (or ears) as shown by "B".

Application of charges to the magnetic toner particles t is effected with respect to end (developing sleeve 1 side) toner particles t1 by contact between the end toner particles t1 in the chains B and the developing sleeve 1. Further, the charges are applied to the end toner particles t1 in the chains B, the toner particles t1 are subjected to a force directed toward the developing sleeve 1 due to a mirror reflection force and are also subjected to a conveying force directed toward a rotational direction of the developing sleeve 1 due to a frictional force between the toner particles and the developing sleeve 1.

Further, since there is some aggregating force between the toner particles t, the conveying force is transmitted to a toner particle t2 contacted with the toner particle t1 via the aggregating force (cohesive force). Similarly, the conveying force is transmitted to a toner particle t3 contacted with the toner particle t2 via the aggregating force.

However, the toner particles t between the developing sleeve 1 and the magnetic blade 11 are also subjected to the magnetic force directed toward the magnetic blade 11. Accordingly, at a point where the conveying force acting on the toner particles overcomes the magnetic force, i.e., at the cut line L shown in FIG. 7, the toner chains B are broken, and the toner remaining on the developing sleeve 1 is conveyed in the rotational direction of the developing sleeve 1.

Accordingly, when magnetic toner having high aggregation (cohesive degree) or magnetic toner requiring greater contacting number to obtain the required frictional charge amount is used, toner particles not contacted with the developing sleeve 1 and thus having poor charges will be conveyed to the developing portion, thereby causing a poor image due to poor charging in the development.

In order to solve this problem, the inventors have proposed a technique in which, as shown in FIG. 8, a regulating sleeve 5 having a non-rotatable magnet 5*a* therein is provided as a developer regulating member for a developing sleeve 1 and a magnetic pole S21 of the magnet 5*a* is opposed to a magnetic pole N11 of a magnet 1*a* in the developing sleeve 1 and the regulating sleeve 5 is rotated in a direction opposite to the rotational direction of the developing sleeve 1 at an opposed area between the regulating sleeve and the developing sleeve.

With this arrangement, at the toner regulating portion where the developing sleeve 1 is opposed to the regulating sleeve 5, the magnetic toner on the developing sleeve 1 receives a conveying force mainly depending upon the charged amount of toner and directing toward the rotational direction of the developing sleeve 1 and a conveying force mainly depending upon the magnetic force and directing toward the rotational direction of the regulating sleeve 5, so that only sufficiently charged toner can be remained and uniformly coated on the surface of the developing sleeve 1 and be conveyed to the developing portion opposed to the photosensitive drum 100.

However, in the developing apparatus as shown in FIG. 8, since the amount of toner coated on the developing sleeve 1 is about ⅓ to ½ of that in the developing apparatus shown in FIG. 5, in order to obtain the image density, which is the same as that in the developing apparatus of FIG. 5, a rotational speed of the developing sleeve must be increased.

In this case, since the developing apparatus of FIG. 8 has high developing efficiency, even if the toner coating amount is about a half of that in the developing apparatus of FIG. 5, a peripheral speed ratio of the developing sleeve with respect to the photosensitive drum (rotational speed of developing sleeve/rotational speed of photosensitive drum) is not required to be twice, and, in order to obtain the same density as that of an image under the condition of a sleeve peripheral speed ratio of 1.2 to 1.5 frequently set in the developing apparatus of FIG. 5, a sleeve peripheral speed ratio may be set to 2 to 2.5. However, the sleeve peripheral speed ratio must still be set to a high value.

Accordingly, in response to high speed image formation of recent electrophotographic apparatuses, when the photosensitive drum is rotated at a higher speed, the rotational speed of the developing sleeve is increased more and more, with the result that, when toner having small particle diameter or toner having less magnetism is used, it is difficult to coat the toner on the developing sleeve stably.

SUMMARY OF THE INVENTION

An object of the present invention is to provide a development apparatus in which a high quality image can be obtained.

Another object of the present invention is to provide a development apparatus in which a high speed operation of a developing sleeve can be suppressed even when image formation is effected at a high speed, and, even when toner having small particle diameter or toner having less magnetism is used, magnetic toner having good charging characteristics can be coated on a developing sleeve stably and be applied to development.

A further object of the present invention is to provide a development apparatus comprising a first developer carrying member for carrying developer and adapted to develop a latent image formed on an image bearing member with the developer at a first developing area, a second developer carrying member for carrying the developer and adapted to develop the latent image formed on the image bearing member with the developer at a second developing area, and a regulating member borne on the second developer carrying member and adapted to regulate a thickness of a layer of the developer, and wherein the second developer carrying member regulates a thickness of a layer of the developer carried on the first developer carrying member.

The other objects and features of the present invention will be apparent from the following detailed explanation of the invention referring to the accompanying drawings.

DETAILED DESCRIPTION OF THE PREFERRED EMBODIMENTS

The present invention will now be explained in connection with embodiments thereof with reference to the accompanying drawings.

[First Embodiment]

Figure 1:
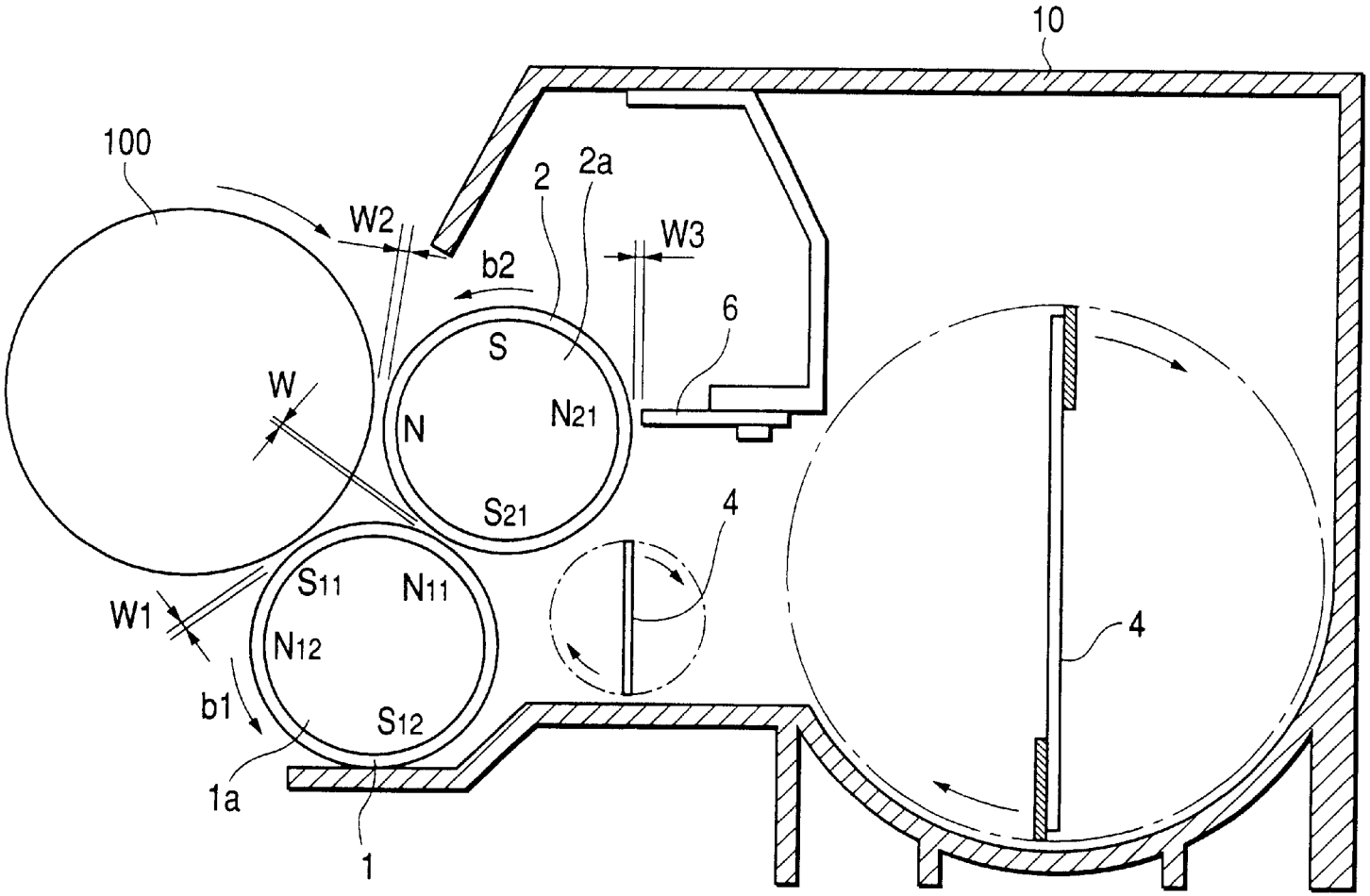
FIG. 1 is a sectional view showing a development apparatus according an embodiment of the present invention.

FIG. 1 is a sectional view showing a development apparatus according to an embodiment of the present invention.

In this embodiment, the development apparatus is characterized in that a second developing sleeve 2 is provided, as well as a first developing sleeve 1.

The development apparatus comprises a developing container 10 containing magnetic toner therein, within which there are disposed, along a rotational direction of a photosensitive drum 100, a first developing sleeve 1 and an upstream second developing sleeve 2. Magnets 1*a*, 2*b* are arranged within the developing sleeves 1, 2, respectively in a non-rotatable manner. The second developing sleeve 2 is provided with a magnetic blade 6 as a developer regulating member. The rotational direction of the developing sleeves 1,2 with respect to the photosensitive drum 100 are defined as a normal (forward) direction (shown by the arrows b1, b2) when they are rotated in the same direction at an opposed area therebetween and are defined as a reverse direction when they are rotated in opposite directions at the opposed area.

The developing sleeves 1, 2 are formed from cylindrical, non-magnetic metallic members and, according to the illustrated embodiment, have outer diameters of 20 mm. Further, minimum distances W1, W2 between the developing sleeves 1, 2 and the photosensitive drum 100 are set to be 200 gm, 300 gm, respectively, and a minimum distance W between the developing sleeves 1 and 2 is set to be 300 $\mu$m. The magnetic blade 6 is disposed in the vicinity of a magnetic pole N21 of the magnet 2*a* within the developing sleeve 2 downstream of the opposed area between the developing sleeves 1, 2 in the rotational direction of the developing sleeve 2. A distance W3 between the magnetic blade and the developing sleeve 2 is set to be 200 $\mu$m.

According to the illustrated embodiment, the magnets 1*a*, 2*a* within the developing sleeves 1, 2 have opposed magnetic poles N11, S21. The magnetic flux density of the magnetic pole N11 is selected to 900 Gauss and the magnetic flux density of the magnetic pole S21 is set to 800 Gauss, and a ratio between widths of areas indicating values greater than 50% (referred to as "50% value" hereinafter) of the peak values of the magnetic flux densities is set to:

(50% value of magnetic pole S21)/(50% value of magnetic pole N11)$\leqq$1.0 and preferably, (50% value of magnetic pole S21)/(50% value of magnetic pole N11)$\leqq$0.8

In the illustrated embodiment, (50% value of magnetic pole S21)/(50% value of magnetic pole N11) was set to about 0.8.

With this arrangement, the change in the magnetic flux density of the magnetic field formed between the magnetic pole S21 and the magnetic pole N11 is increased from the developing sleeve 1 toward the developing sleeve 2, so that a magnetic force directing toward the developing sleeve 2 acts on the toner between the developing sleeves 1 and 2.

In the illustrated embodiment, the magnetic toner used was negatively charged toner having a weight average particle diameter greater than 5 $\mu$m and involved amount of magnetic substance greater than 10 weight %.

According to the development apparatus having the above-mentioned construction, the opposed area between the developing sleeves 1 and 2 acts as a regulating portion for regulating the magnetic toner carried on the developing sleeve 1.

The magnetic toner in the developing container 10 is conveyed toward the developing sleeve 1 by conveying members 4 and is held on the surface of the rotating developing sleeve 1 by the internal magnet 1*a*. The magnetic toner held on the developing sleeve 1 is conveyed to the opposed area between the developing sleeves, where the magnetic toner is subjected to regulation by the magnetic field between the developing sleeves. In this case, among the magnetic toner on the developing sleeve 1, since the magnetic toner disposed in the vicinity of the surface of the developing sleeve 1 is charged with high charged amount by the friction between the toner and the surface of the developing sleeve 1, the magnetic toner is attracted toward the surface of the developing sleeve 1 by the mirror reflection force due to charges. As a result, the magnetic toner passes through the magnetic field in the opposed area between the developing sleeves 1 and 2 and remains on the surface of the developing sleeve 1 and is coated thereon, and then is conveyed, by the friction force on the surface of the rotating developing sleeve 1, toward a developing area (first developing area) where the developing sleeve 1 is opposed to the photosensitive drum 100.

On the other hand, since the magnetic flux density between the developing sleeves 1 and 2 is increased toward the developing sleeve 2 to provide the magnetic force acting from the developing sleeve 1 to the developing sleeve 2, the remaining magnetic toner having poor charging on the developing sleeve 1 is magnetically attracted to the developing sleeve 2 and is conveyed together with the magnetic toner on the developing sleeve 2 toward the interior of the developing container 10 by the frictional force on the surface of the developing sleeve 2.

Figure 7:
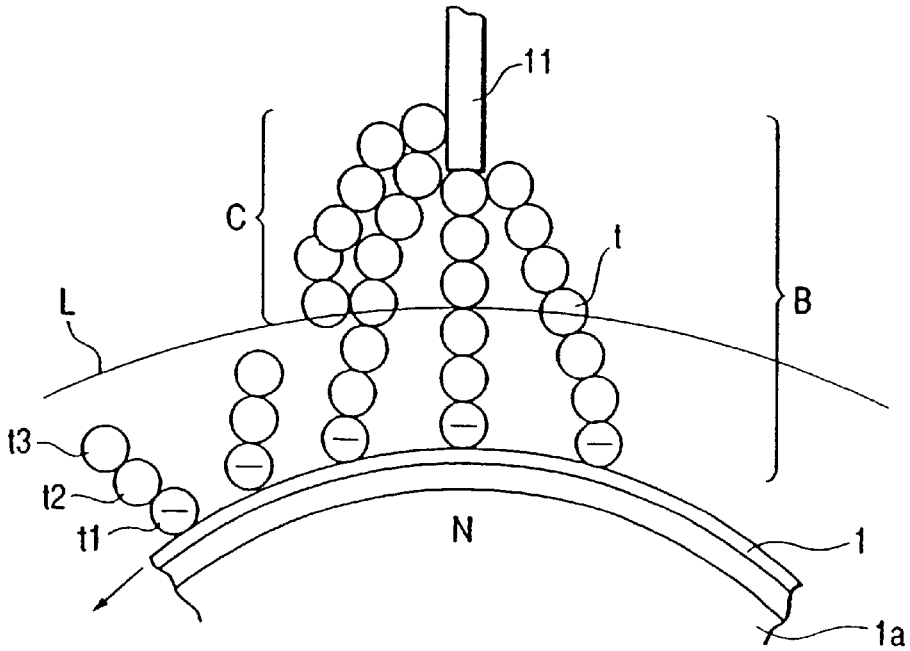
FIG. 7 PRIOR ART
FIG. 7 is an explanatory view showing performance of the magnetic toner at the regulating portion of FIG. 6.
Figure 8:
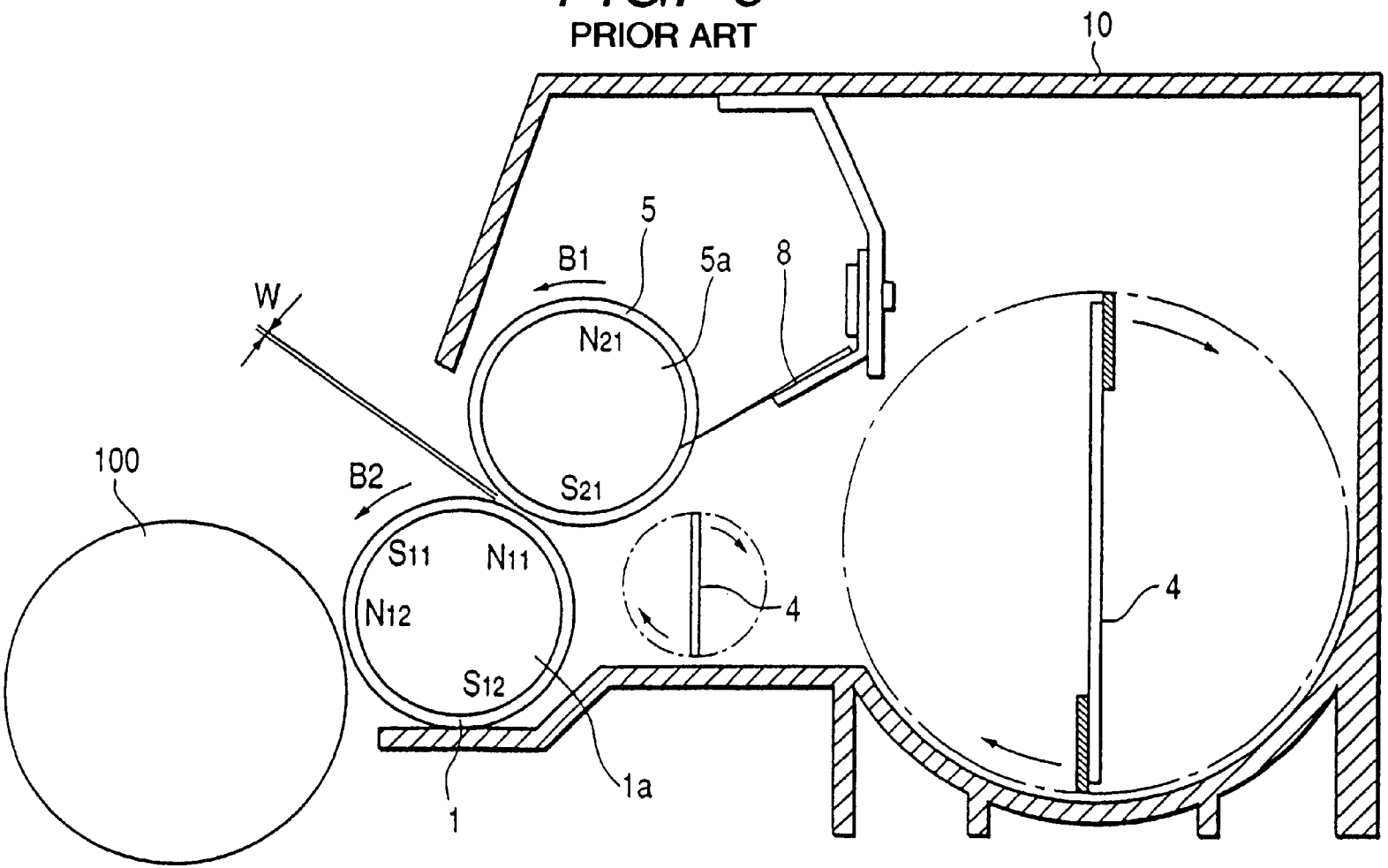
FIG. 8 PRIOR ART
FIG. 8 is a sectional view showing another example of a conventional developing apparatus.

The magnetic toner on the developing sleeve 2 and the magnetic toner attracted thereto are conveyed to the magnetic blade 6, where a thickness of a layer of toner is regulated. As shown in FIG. 7, after the toner forms the toner chains on the developing sleeve 2 and is broken and is coated on the developing sleeve 2, the toner is conveyed to a developing area (second developing area) where the developing sleeve 2 is opposed to the photosensitive drum 100.

As sequence of development, the latent image on the photosensitive drum 100 reaches the developing area between the photosensitive drum and the developing sleeve 2 and then is firstly developed by the magnetic toner on the developing sleeve 2. Since the toner on the developing sleeve 2 includes the toner having poor charging, the toner image on the photosensitive drum 100 visualized by this development may cause poor imaging such as fog and/or tailing, and the density of the toner image may be insufficient. Then, the toner image reaches the developing area between the photosensitive reciprocal movement between the photosensitive drum 100 and the developing sleeve 1, with the result that the toner having poor charging is collected to the developing sleeve 1, and the latent image is developed again by the toner having sufficient charging on the photosensitive drum 100 and the toner having sufficient charging from the developing sleeve 1.

As a result, if the rotational speed of the photosensitive drum 100 is increased due to high speed image formation of the image forming apparatus, even when the rotational speeds of the developing sleeves 1, 2 is not so increased (about 1.5 times), an image having adequate density can be obtained. Further, even when the toner having small particle diameter or the toner having a smaller amount of magnetic substance is used, the toner coating on the developing sleeve can stably be attained and stable development can be achieved.

[Second Embodiment]

Figure 2:
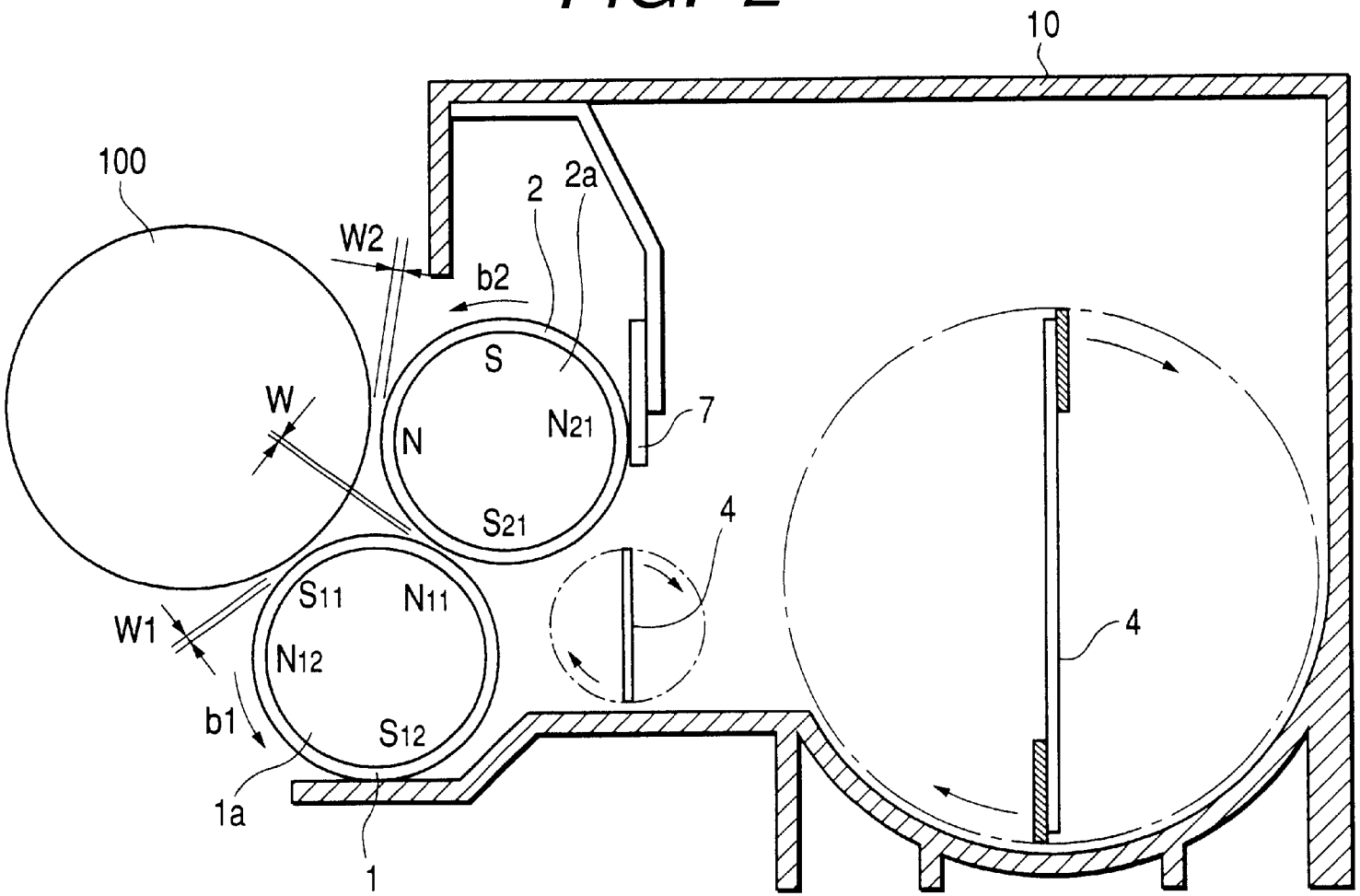
FIG. 2 is a sectional view showing a development apparatus according another embodiment of the present invention.

FIG. 2 is a sectional view showing a development apparatus according to another embodiment of the present invention.

In this embodiment, an elastic blade 7 is provided as the developer regulating member for the second developing sleeve 2. Since the other constructions of this embodiment are the same as those in the embodiment shown in FIG. 1, the same elements as those in FIG. 1 are designated by the same reference numerals.

The elastic blade 7 abuts against the surface of the developing sleeve 2 in a direction opposite to the rotational direction of the developing sleeve 2 at a downstream side of the opposed area between the developing sleeves 1 and 2 (more specifically, at a magnetic pole N21 of the magnet 2*a* within the developing sleeve 2). Accordingly, the magnetic toner on the developing sleeve 2 is frictionally charged by the urging force of the elastic blade 7 and a thickness of the toner layer is regulated, and the toner is coated on the developing sleeve 2.

Also in this embodiment, since the latent image on the photosensitive drum 100 is developed by the magnetic toner on the developing sleeve 2 and then is developed by the magnetic toner having sufficient charging on the developing sleeve 1, if the rotational speed of the photosensitive drum 100 is increased due to high speed image formation of the image forming apparatus, even when the rotational speeds of the developing sleeves 1, 2 is not so increased (about 1.5 times), an image having adequate density can be obtained. Further, even when toner having a small particle diameter or toner having smaller amounts of magnetic substance is used, toner coating on the developing sleeve can stably be attained and stable development can be achieved.

[Third Embodiment]

Figure 3:
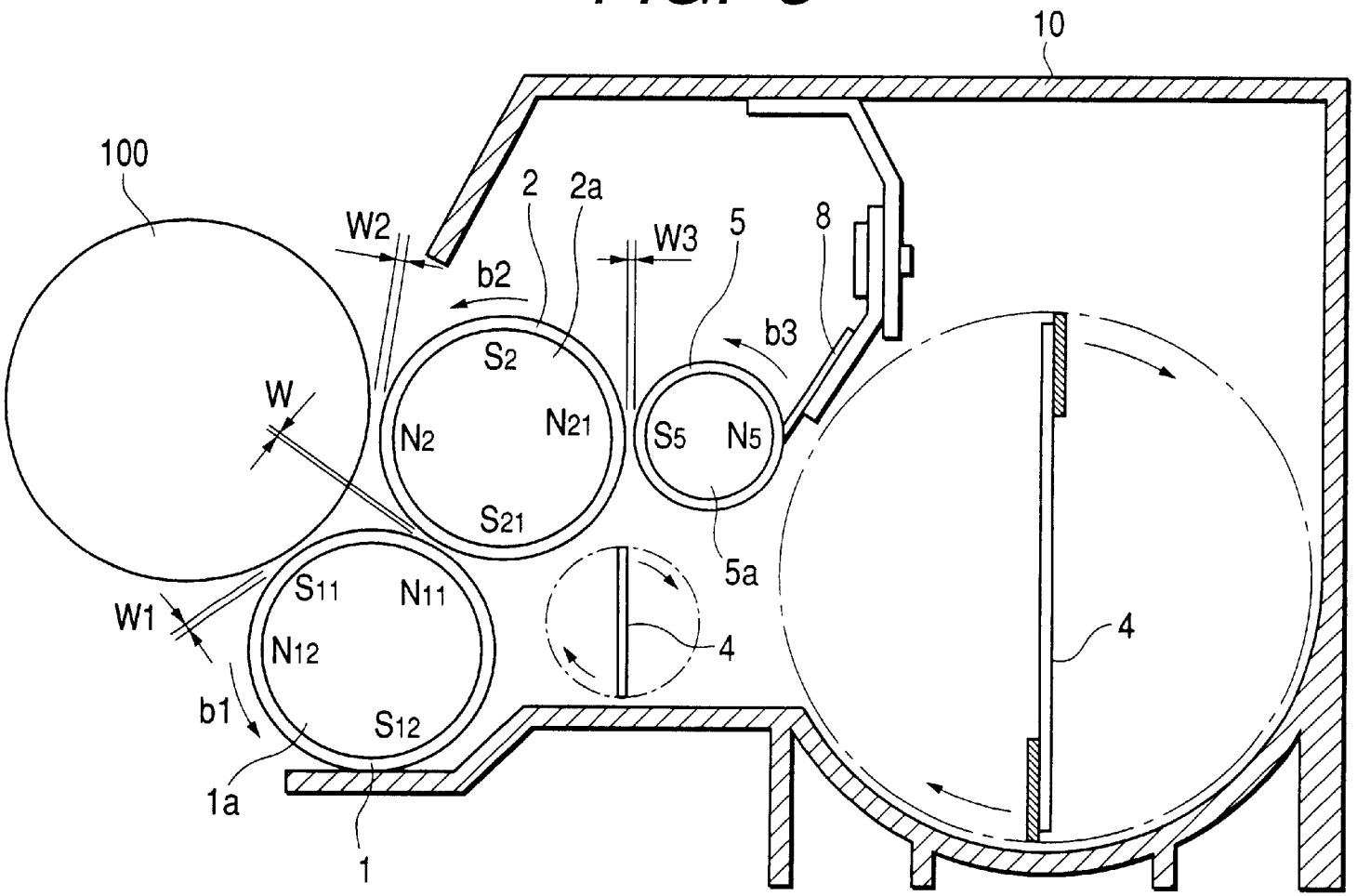
FIG. 3 is a sectional view showing a development apparatus according to a further embodiment of the present invention.

FIG. 3 is a sectional view showing a development apparatus according to a further embodiment of the present invention.

In the first and second embodiments shown in FIGS. 1 and 2, although the developing sleeve 2 is coated by only the toner having sufficient charging, but the developing sleeve 2 is coated by the toner having poor charging, as well as the toner having sufficient charging. Also in such a case, when the development is effected again by the toner on the developing sleeve 1, since the toner distribution of the toner image on the photosensitive drum 100 is re-arranged, the poor imaging due to the poor toner charging is hard to occur.

However, when the toner has small amount of magnetic substance or has high cohesive degree, the toner having poor charging may not be returned from the photosensitive drum 100 to the developing sleeve 1 by re-arranging the toner image obtained by the development based on the developing sleeve 1 by means of the development based on the developing sleeve 2.

In consideration of this, according to the third embodiment, in the development apparatus according to the first embodiment shown in FIG. 1, in place of the magnetic blade 6 for the second developing sleeve 2, as shown in FIG. 3, a rotating toner regulating sleeve 5 having a magnet 5*a* therein in a non-rotatable manner is provided. A scraper 8 is associated with the regulating sleeve 5. Since the other aspects of the construction of the third embodiment are the same as those in the first embodiment, the same elements as those in FIG. 1 are designated by the same reference numerals in FIG. 3.

The regulating sleeve 5 is formed from a non-magnetic metallic material having an outer diameter of 15 mm and is disposed with respect to the developing sleeve 2 with a distance W3 of 300 $\mu$m therebetween similar to the magnetic blade 6 in the first embodiment and is rotated in a reverse direction (shown by the arrow b3) at an opposed area between the developing sleeve and the regulating sleeve. The magnet 5*a* in the regulating sleeve 5 and the magnet 2*a* in the developing sleeve 2 are opposed to each other with magnetic poles S5 and N21. The magnetic flux density of the magnetic pole S5 is selected to 800 Gauss and the magnetic flux density of the magnetic pole N21 is set to 900 Gauss, and a ratio between widths of areas indicating values greater than 50% of the peak values of the magnetic flux densities is set to:

(50% value of magnetic pole S5)/(50% value of magnetic pole N21)$\leqq$1.0 and preferably, (50% value of magnetic pole S5)/(50% value of magnetic pole N21)$\leqq$0.8.

In the illustrated embodiment, (50% value of magnetic pole S5)/(50% value of magnetic pole N21) was set to about 0.8.

With this arrangement, the change in the magnetic flux density of the magnetic field formed between the magnetic pole S5 and the magnetic pole N21 is increased from the developing sleeve 2 toward the regulating sleeve 5, so that a magnetic force directing toward the regulating sleeve 5 acts on the toner between the developing sleeve 2 and the regulating sleeve 5.

By the way, the magnetic toner held on the developing sleeve 2 and the magnetic toner attracted thereto from the developing sleeve 1 are conveyed to the opposed area between the developing sleeve 2 and the regulating sleeve 5 in a condition that the toner having poor charging is included, and, at this opposed area the magnetic toner is subjected to regulation due to the magnetic field formed between the developing sleeve 2 and the regulating sleeve 5. In this case, among the magnetic toner on the developing sleeve 2, since the magnetic toner disposed in the vicinity of the surface of the developing sleeve 2 is charged to a high charge amount by the friction between the toner and the surface of the developing sleeve 2, the magnetic toner is attracted toward the surface of the developing sleeve 2 by the mirror reflection force due to charges. As a result, the magnetic toner passes through the magnetic field in the opposed area between the developing sleeve 2 and the regulating sleeve 5 and remains on the surface of the developing sleeve 2 and is coated thereon, and then is conveyed, by the frictional force on the surface of the rotating developing sleeve 2, toward a developing area (first developing area) where the developing sleeve 2 is opposed to the photosensitive drum 100.

On the other hand, since the magnetic flux density between the developing sleeve 2 and the regulating sleeve 5 is increased toward the regulating sleeve 5 to provide the magnetic force acting from the developing sleeve 2 to the regulating sleeve 5, the remaining magnetic toner having poor charging on the developing sleeve 2 is magnetically attracted to the regulating sleeve 5 and is conveyed, by the rotation of the regulating sleeve 5, to the scraper 8, where the toner is stripped from the regulating sleeve 5 and is collected into the developing container 10.

According to the illustrated embodiment, in this way, the toner having poor charging on the developing sleeves 1, 2 is returned to the developing container 10 and only the toner having sufficient charging is coated on the developing sleeves 1, 2, and the development of the photosensitive drum 100 is effected by the sleeves 1, 2. Accordingly, the poor imaging due to the toner having poor charging can be prevented.

As a result, if the rotational speed of the photosensitive drum 100 is increased due to high speed image formation of the image forming apparatus, even when the rotational speeds of the developing sleeves 1, 2 is not so increased (about 1.5 times), an image having adequate density can be obtained. Further, even when toner having a small particle diameter or toner having smaller amounts of magnetic substance is used, the toner coating on the developing sleeve can stably be attained and stable development can be achieved.

[Fourth Embodiment]

Figure 4:
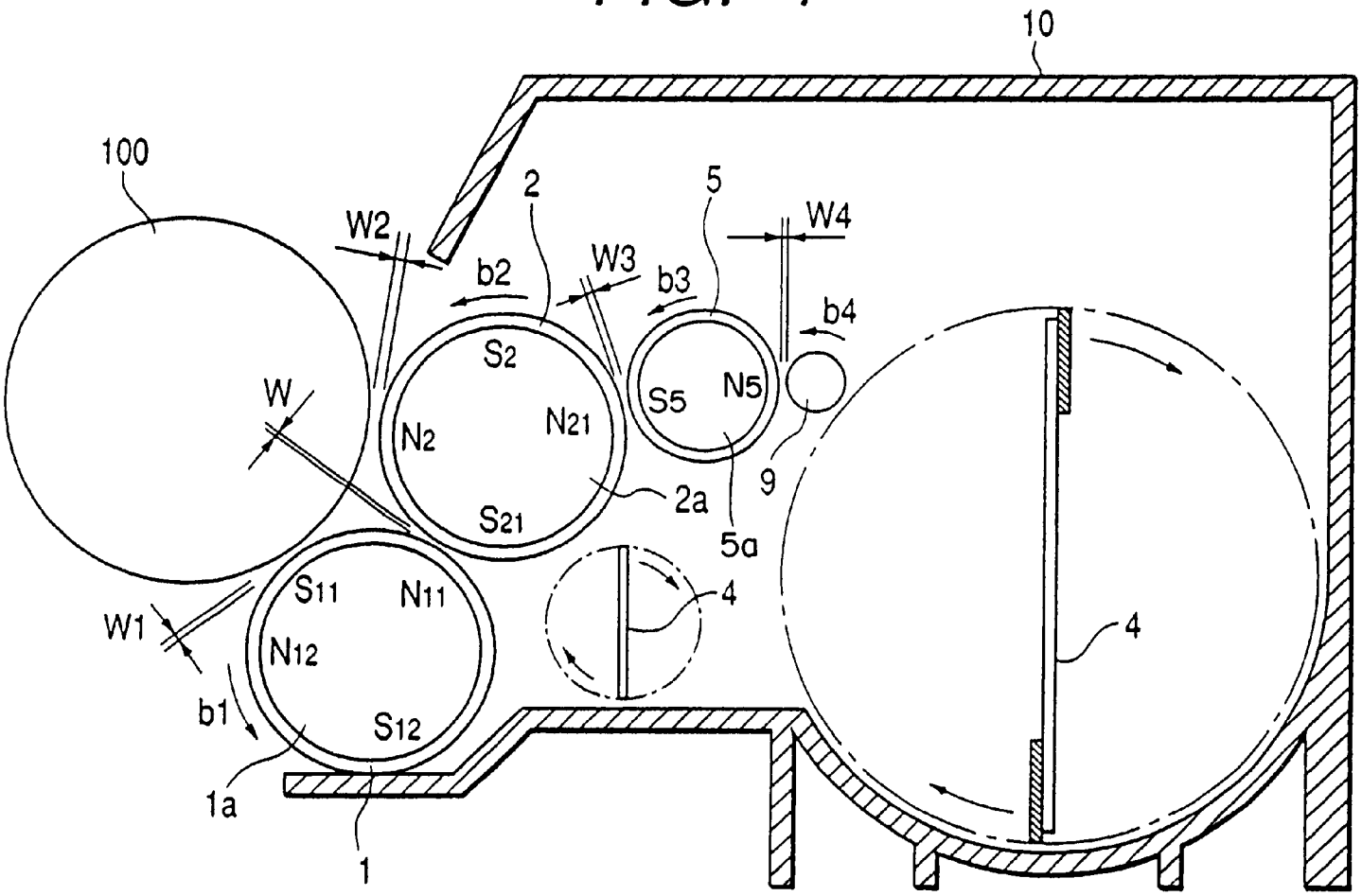
FIG. 4 is a sectional view showing a development apparatus according to a still further embodiment of the present invention.
Figure 5:
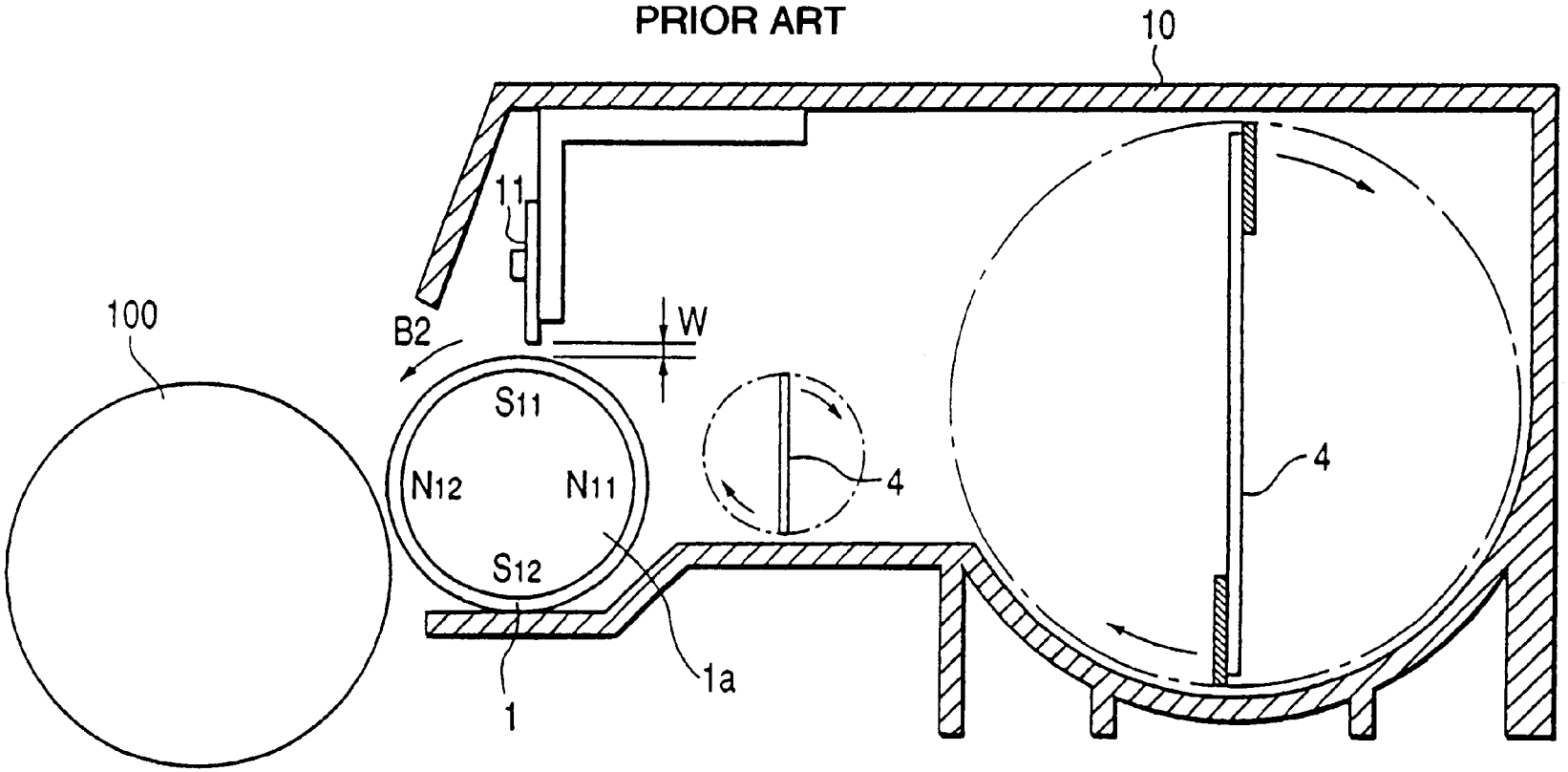
FIG. 5 PRIOR ART
FIG. 5 is a sectional view of a conventional developing apparatus.
Figure 6:
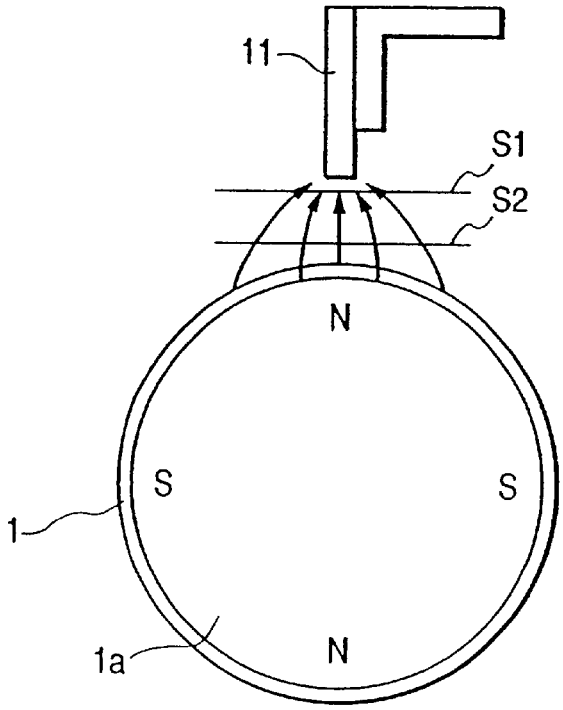
FIG. 6 PRIOR ART
FIG. 6 is an explanatory view showing a regulating portion comprised of a magnetic blade and adapted to regulate magnetic toner on a developing sleeve of the developing apparatus of FIG. 5.

FIG. 4 is a sectional view showing a development apparatus according to a still further embodiment of the present invention.

In this embodiment, a collecting roller (toner stripping electrode) 9 comprised of a non-magnetic solid metal cylinder is used as a toner collecting member associated with the toner regulating sleeve 5. The other aspects of the construction are the same as those in the third embodiment shown in FIG. 3. Thus, in FIG. 4, the same elements as those shown in FIG. 3 are designated by the same reference numerals and explanation thereof will be omitted.

The collecting roller 9 is disposed in the vicinity of the magnetic pole N5 of the magnet within the regulating sleeve 5 at a distance W4 selected to be 200 $\mu$m between the regulating sleeve 5 and the roller and is rotated in a direction shown by the arrow b4. In order to collect the toner on the regulating sleeve 5, a DC bias is applied between the roller and the regulating sleeve 5 so that potential of the roller becomes greater than that of the regulating sleeve 5 by about 500 V.

The collecting mechanism is as follows. When the toner held on the surface of the regulating sleeve 5 and conveyed reaches the vicinity of the magnet pole N5 of the magnet 5*a* within the regulating sleeve 5, the toner chains are formed by the magnetic force. Due to the bias applied between the regulating sleeve 5 and the collecting roller 9, a force directed toward the collecting roller 9 acts on the toner forming the toner chains. Since the toner chains on the regulating sleeve 5 have a smaller contact area with the regulating sleeve 5 due to the formation of toner chains, the toner chains are easily stripped from the regulating sleeve 5 by the force directed toward the collecting roller 9.

Also in this embodiment, the toner having poor charging on the developing sleeves 1, 2 are returned to the interior of the developing container 10, and only the toner having sufficient charging is coated on the developing sleeves 1, 2, and the development of the photosensitive drum 100 is effected by the sleeves 1, 2. Accordingly, the poor imaging due to the toner having poor charging can be prevented.

As a result, if the rotational speed of the photosensitive drum 100 is 4 increased due to high speed image formation of the image forming apparatus, even when the rotational speeds of the developing sleeves 1, 2 is not so increased (about 1.5 times), an image having adequate density can be obtained. Further, even when toner having a small particle diameter or toner having smaller amounts of magnetic substance is used, the toner coating on the developing sleeve can stably be attained and stable development can be achieved.

As mentioned above, according to the illustrated embodiments, within the developing container containing the magnetic toner, there are provided the first developer carrying member and the upstream second developer carrying member which are disposed along the rotational direction of the image bearing member, and the rotational directions of the first and second developer carrying members toward the image bearing member are defined as the normal direction, and the rotational directions of the first and second developer carrying members opposed to each other are defined as the reverse direction, and the magnetic flux density of the magnetic field in the opposed area between the first and second developer carrying members is increased toward the second developer carrying member thereby to act the magnetic force directing toward the second developer carrying member on the magnetic toner in the opposed area.

With this arrangement, among the magnetic toner on the first developer carrying member, in the condition that only the toner having a high charge amount is remaining, the toner is conveyed to the first developing area between the first developer carrying member and the image bearing member, and the magnetic toner remaining on the first developer carrying member is attracted to the second developer carrying member and, after this toner is regulated together with the magnetic toner on the second developer carrying member by the developer regulating member, they are conveyed to the second developing area between the second developer carrying member and the image bearing member thereby to develop the latent image on the image bearing member at the second developing area, and the image is developed again with the magnetic toner having the adequate charged amount in the first developing area. Thus, regarding high speed image formation, the image having adequate density can be obtained in the condition that the high speed operation of the image bearing member is suppressed, and even when a toner having a small particle diameter or toner having small amounts of magnetic substance is used, the magnetic toner having sufficient charging can be coated on the developer carrying member stably to be supplied for the development.

What is claimed is:

1. A development apparatus comprising:

a first developer carrying member for carrying developer and adapted to develop a latent image formed on an image bearing member with the developer at a first developing area;

a second developer carrying member for carrying the developer and adapted to develop the latent image formed on said image bearing member with the developer at a second developing area; and a regulating member borne on said second developer carrying member and adapted to regulate a thickness of a layer of the developer, wherein said first developer carrying member is provided with a first magnetic field generating means in its interior, said second developer carrying means is provided with a second magnetic field generating means in its interior, said first magnetic field generating means is provided with a first magnetic pole and a second magnetic pole which are arranged adjacent to each other in a circumferential direction with respect to a minimum adjacent portion between said first and second developer carrying members, said first magnetic pole and said second magnetic pole being of mutual, reverse polarity, said second magnetic field generating means is provided with a third magnetic pole and a fourth magnetic pole, which are arranged adjacent to each other in a circumferential direction with respect to said minimum adjacent portion, said third magnetic pole and said fourth magnetic pole being of mutual, reverse polarity, and said second developer carrying member regulates a thickness of a layer of the developer carried on said first developer carrying member.

2. A development apparatus according to claim 1, wherein a rotating direction of said first developer carrying member is opposite to a rotating direction of said second developer carrying member at an opposed area between said first and second developer carrying members.

3. A development apparatus according to claim 1, wherein said second developer carrying member is disposed at an upstream side of said first developer carrying member in a rotational direction of said image bearing member.

4. A development apparatus according to claim 3, wherein the latent image formed on said image bearing member is developed with the developer borne by said second developer carrying member at the second developing area and then is developed with the developer borne by said first developer carrying member at the first developing area.

5. A development apparatus according to claim 1, wherein a magnetic flux density of a magnetic field in an opposed area between said first and second developer carrying members is increased toward said second developer carrying member.

6. A development apparatus according to claim 5, wherein said regulating member is disposed at a downstream side of the opposed area between said first and second developer carrying members in a rotational direction of said second developer carrying member and is not contacted with said second developer carrying member, and the developer on said second developer carrying member is magnetically regulated by the magnetic field between said second developer carrying member and said regulating member.

7. A development apparatus according to claim 1, wherein said regulating member comprises an elastic blade disposed at a downstream side of the opposed area between said first and second developer carrying members in a rotational direction of said second developer carrying member and contacted with said second developer carrying member, and the developer on said second developer carrying member is regulated by said elastic blade.

8. A development apparatus according to claim 1, wherein said regulating member comprises a rotating regulating sleeve disposed at a downstream side of the opposed area between said first and second developer carrying members in a rotational direction of said second developer carrying member and rotated without contacting with said second developer carrying member, and third magnetic field generating means provided within said regulating sleeve in a non-rotatable manner, and a rotational direction of said regulating sleeve is a reverse direction in which said regulating sleeve and said second developer carrying member are rotated in opposite directions at an opposed area therebetween, and magnetic flux density of a magnetic field between said second developer carrying member and said regulating sleeve is increased toward said regulating sleeve, and the developer on second developer carrying member is regulated by the magnetic field between said second developer carrying member and said regulating sleeve.

9. A development apparatus according to claim 8, further comprising a scraper disposed at a downstream side of the opposed area between said second developer carrying member and said regulating sleeve in a rotational direction of said regulating sleeve and contacted with said regulating sleeve, and wherein said scraper removes the developer on said regulating sleeve.

10. A development apparatus according to claim 8, further comprising a stripping electrode formed from non-magnetic metal and disposed at a downstream side of the opposed area between said second developer carrying member and said regulating sleeve in a rotational direction of said regulating sleeve and not contacted with said regulating sleeve, and wherein the developer on said regulating sleeve is electrically removed by applying voltage having polarity opposite to charging polarity of the developer to said stripping electrode.

* * * * *

UNITED STATES PATENT AND TRADEMARK OFFICE

CERTIFICATE OF CORRECTION

PATENT NO. : 6,397,031 B1
DATED : May 28, 2002
INVENTOR(S) : Isami Itoh et al.

It is certified that error appears in the above-identified patent and that said Letters Patent is hereby corrected as shown below:

Title page, Item [54] and Column 1, line 3,
"MEMBER" should read -- MEMBERS --.
Item [56], References Cited, FOREIGN PATENT DOCUMENTS,
"42-23910 11/1942" should read -- 42-23910 11/1967 --; and
"43-24748 10/1943" should read -- 43-24748 10/1968 --.

Column 2,
Line 22, "if" should read -- by --; and
Line 41, "including" should read -- includes --; and "developing." should read -- developing --.

Column 4,
Line 19, "to be twice," should read -- to be doubled --;
Line 41, "small" should read -- a small --;
Line 64, "according" should read -- according to --; and
Line 66, "according" should read -- according to --.

Column 7,
Line 3, "photosensitive reciprocal" should read -- photosensitive drum and the developing sleeve 1, where, by an AC voltage, a developing bias is applied between the developing sleeve 1 and the photosensitive drum 100, the toner repeats reciprocal --;
Line 13, "is not" should read -- are not --;
Line 15, "small" should read -- a small --;
Line 47, "is not" should read -- are not --;
Line 59, "but" should be deleted;
Line 65, "is hard to occur" should read -- is unlikely to occur --; and
Line 66, "has" should read -- has a --.

Column 8,
Line 26, "selected" should read -- set --.

Column 9,
Line 62, "are" should read -- is --.

UNITED STATES PATENT AND TRADEMARK OFFICE

CERTIFICATE OF CORRECTION

PATENT NO. : 6,397,031 B1
DATED : May 28, 2002
INVENTOR(S) : Isami Itoh et al.

It is certified that error appears in the above-identified patent and that said Letters Patent is hereby corrected as shown below:

Column 10,
Line 2, “is 4” should read -- is --; and
Line 4, “is not” should read -- are not --.

Signed and Sealed this

Twenty-ninth Day of October, 2002

*Attest:*

*Attesting Officer*

JAMES E. ROGAN
*Director of the United States Patent and Trademark Office*